United States Patent [19]

Toby

[11] 4,067,435

[45] Jan. 10, 1978

[54] APPARATUS FOR ALIGNING ROWS OF STACKED ARTICLES

[76] Inventor: Edward P. Toby, 785 Bowhill Road, Hillsborough, Calif. 94010

[21] Appl. No.: 690,666

[22] Filed: May 27, 1976

Related U.S. Application Data

[62] Division of Ser. No. 582,659, June 6, 1975, Pat. No. 3,994,386.

[51] Int. Cl.[2] ..... B65G 47/26

[52] U.S. Cl. ..... 198/434; 198/419; 198/456; 198/459; 214/65; 271/239

[58] Field of Search ..... 193/35 G; 198/419, 459, 198/425, 456, 458, 434; 271/239, 245, 221, 222, 238; 214/65

[56] References Cited

U.S. PATENT DOCUMENTS

| | | | |
|---|---|---|---|
| 1,633,937 | 6/1927 | Ford | 271/221 UX |
| 2,517,388 | 8/1950 | Daves | 214/65 |
| 2,571,790 | 10/1951 | Tomkins | 198/419 |
| 2,949,179 | 8/1960 | Busse | 198/419 |
| 2,953,234 | 9/1960 | Abendschein | 198/425 X |
| 3,667,622 | 6/1972 | Kamphues et al. | 198/419 X |
| 3,788,497 | 1/1974 | Carlson | 198/419 X |

*Primary Examiner*—John J. Love
*Assistant Examiner*—Douglas D. Watts
*Attorney, Agent, or Firm*—Harris Zimmerman

[57] ABSTRACT

An apparatus for handling individual sliced stacks of a comestible product includes a first roller dropper unit which arranges the output of a slicer into adjacent stacks, and drops the stacks onto a weighing scale. Accepted pairs of stacks are carried by parallel transfer conveyors to second and third roller dropper units which each accumulate two stacks, and which then drop them simultaneously onto a channelizer assembly. The channelizer assembly includes a plurality of parallel, drivable rollers mounted in a frame which is selectively translatable laterally in the direction of the roller axes. The channelizer receives four stacks from the roller dropper units, indexes laterally and receives four more stacks to form a 2×4 matrix. The rollers are then driven to unload the stacks onto a ramp conveyor which leads to a vacuum packaging machine. The ramp conveyor includes momentarily actuable stop tabs which bring the rows into exact alignment before being wrapped simultaneously.

2 Claims, 36 Drawing Figures

APPARATUS FOR ALIGNING ROWS OF STACKED ARTICLES

REFERENCE TO PRIOR APPLICATION

This application is a division of application Ser. No. 582,659, filed on June 6, 1975, now U.S. Pat. No. 3,994,386.

BACKGROUND OF THE INVENTION

In the field of food packaging it is well recognized that wrapping a comestible product in small increments is desirable, as this technique permits a portion of the product to be consumed without exposing the remainder to the deleterious effects of air, bacteria, light, oxygen, odors, etc. It is especially desirable to provide a plurality of packets of sliced luncheon meat or the like in one package, as this type of food is often consumed in small amounts over a period of days.

A machine to produce such a package efficiently and economically is not known in the prior art. Since high speed slicers are typically used in the food processing industry, it is necessary either to wrap small stacks serially at very high speeds, or to form the consecutive stacks from the slicer into parallel streams of small stacks which can be wrapped simultaneously at a much reduced rate. The latter approach is more feasible, and machines attempting to accomplish this task using various conveyor arrangements have been constructed. Generally speaking, the conveyors used to shift the stacks into parallel arrangement have not exhibited the exacting controllability required to create the properly aligned rows of stacks which are required by the packaging machine.

SUMMARY OF THE INVENTION

The present invention provides an apparatus which channels the output of a comestible product slicer into parallel rows of small stacks of the product. The rows are then fed two at a time into a vacuum packaging machine where each stack is separately wrapped, and the packets are assembled into a single package. individual packets may then be consumed as needed without exposing the remaining contents of the package to the air.

The apparatus generally consists of stacking grids which receive two slices from the superjacent comestible product slicer, and indexes to deposit the two slice stack onto a roller dropper unit. As the stacking grid repeats this step, the rollers are driven to move the first stack and make room for the succeeding stack. After two stacks are disposed adjacently on the roller dropper, they are dropped onto a weighing platform.

If both stacks meet the weight criteria, they are conducted separately along parallel transfer conveyors to a pair of roller dropper units. Through iteration each roller dropper acquires a pair of stacks. At this point both roller droppers are actuated simultaneously to deposit the four stacks onto a channelizer unit disposed therebelow.

The channelizer unit comprises a plurality of rollers extending laterally beneath the pair of roller droppers. The rollers are selectively drivable, and are secured in a carriage Which is translatable along rails which are parallel to the rollers. The first four stacks form two columns of two stacks. As the pair of roller droppers fill again, the channelizer carriage translates along its rails, so that the next two columns of two will be deposited adjacent the first two columns. After his occurrence the channelizer rollers are supporting two rows of four stacks each.

The channelizer rollers are then driven to transfer the accumulated stacks onto four parallel ramp conveyors, each column being delivered to a separate conveyor. Each ramp conveyor is furnished with alignment tabs which momentarily pivot into the path of the stack, thereby aligning it with adjacent stacks on the other conveyors. The stacks are delivered in two rows of four stacks each by the ramp conveyors to a vacuum packaging machine, where the eight stacks are wrapped simultaneously and assembled into a single package. Each process iterates continually, under proper electronic control, so that the apparatus produces one finished package every 2.4 seconds.

THE DRAWING

DESCRIPTION OF THE PREFERRED EMBODIMENT

The present invention generally comprises apparatus for receiving small stacks of slices (i.e., two slices per stack) of a comestible product from a high speed slicer, and sorting these stacks into a matrix array of exactly aligned rows and columns. These rows are then delivered consecutively to a vacuum wrapping machine, where two rows are wrapped simultaneously to form a plurality of packets which are assembled into a single commercial package. Although in the preferred embodiment the stacks each contain two slices, and the matrix is dimensioned four stacks by two stacks, it may be appreciated that these numbers are merely design parameters which are dictated by the nature of the comestible product and the typical pattern of its consumption, as well as by commercial considerations.

For the sake of clarity and ease of understanding of the preferred embodiment, the elements of the apparatus will be described approximately in their operational order in the apparatus. Subsequently reference will be made to the sequential FIGS. 4 – 20, which depict the interrelated functioning of each element of the apparatus. Initially, a high speed comestible product slicer (not shown) is operated to deliver on demand two slices of the product onto stacking grids. Once the two slices have been received, the stacking grids rotate about a horizontal axis to deposit the two slice stack onto a roller dropper unit 41. A desirable form of controllable slicer embodying the stacking grid is disclosed in U.S. Patent No. 3,587,688, issued to Edward Toby on June 28, 1971.

The roller dropper unit 41 includes two banks of opposed, drivable rollers assembled parallel to one another and in the same horizontal plane. The roller supports are pivotted at one end so that both banks of rollers can be swung downwardly simultaneously. A preferred form of the roller dropper is disclosed in U.S. Pat. No. 3,848,725, issued to Max E. Toby on Nov. 19, 1974.

Figure 1:
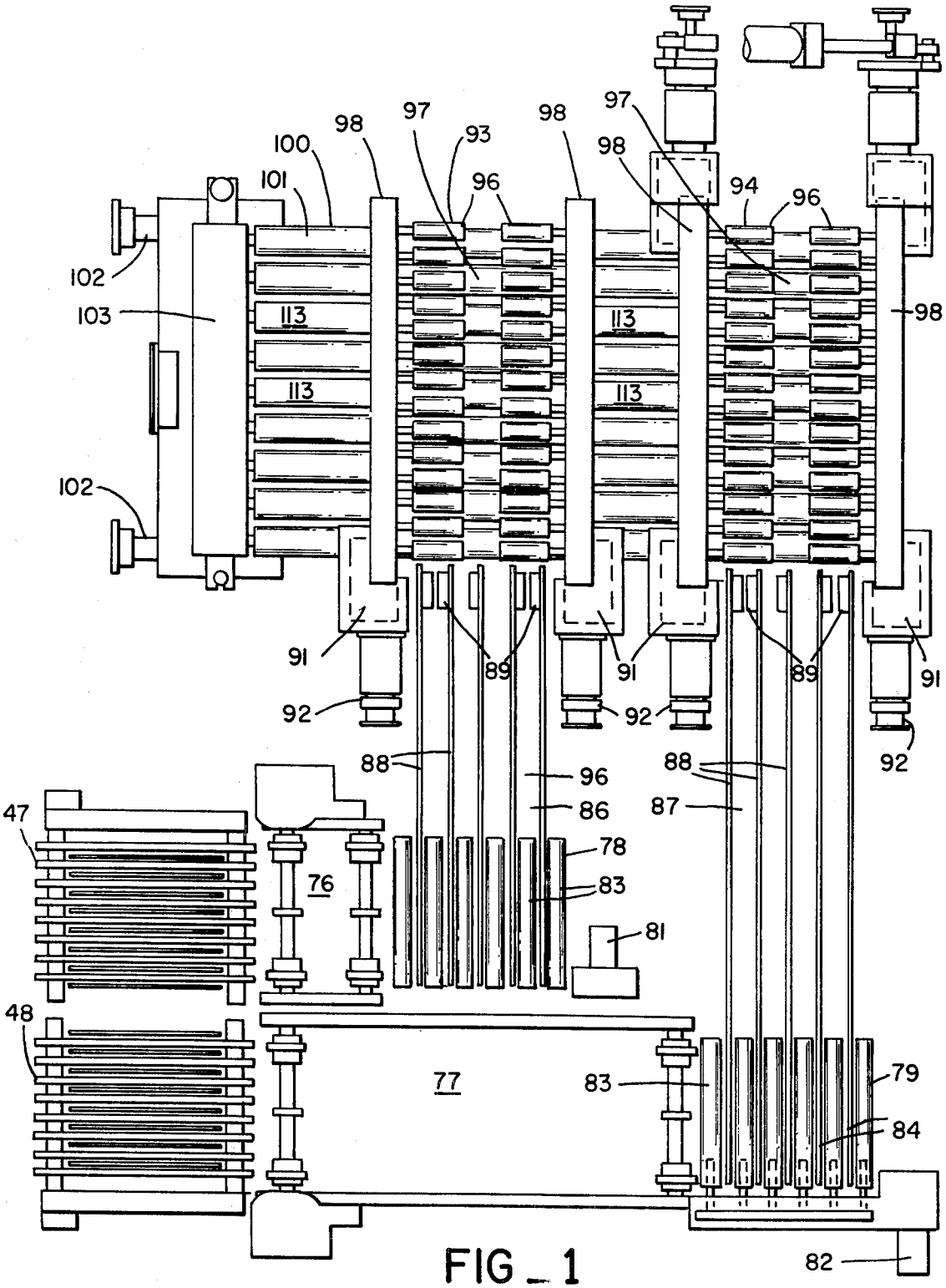
FIG. 1 is an overall plan view of the apparatus of the present invention.
Figure 2:
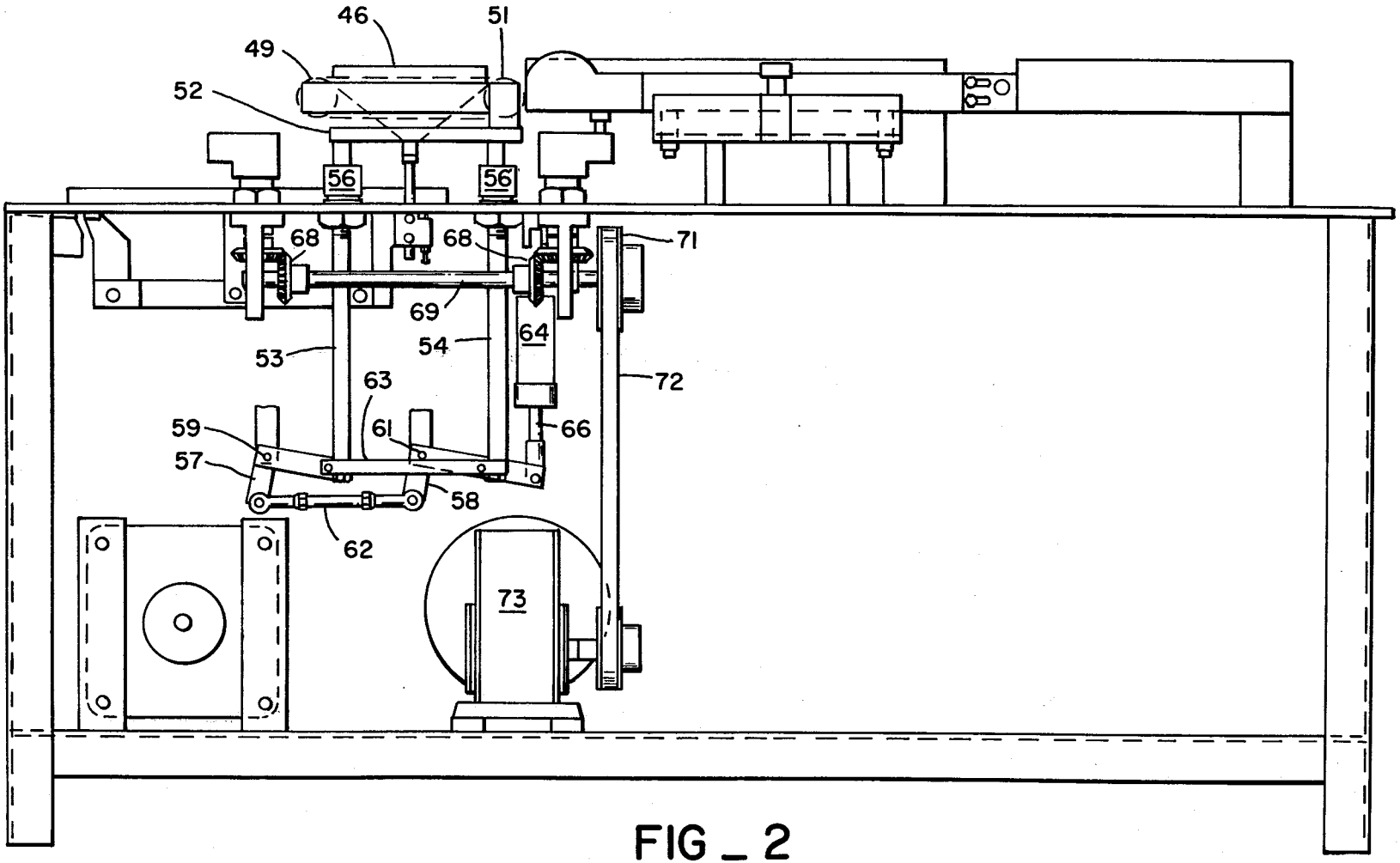
FIG. 2 is a side elevation of the apparatus of the present invention.
Figure 3:
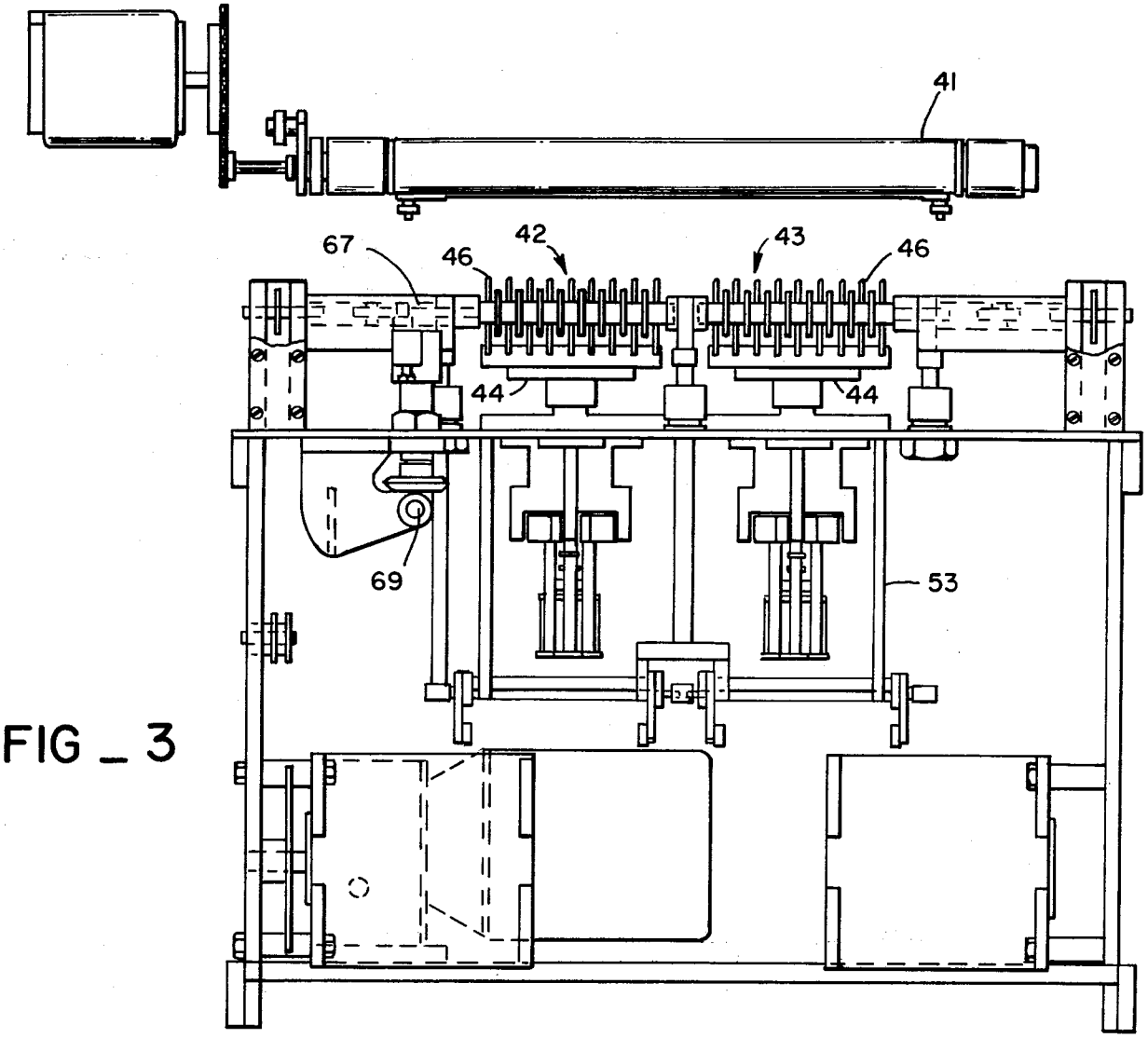
FIG. 3 is a front elevation of the apparatus of the present invention.

As shown in FIGS. 1-3, disposed below the roller dropper unit 41 are a pair of weighing scales 42 and 43. The weighing platform 44 of each scale includes a grid of parallel, vertical plates 46 which are adapted to support the stacks of sliced comestible product. Disposed between adjacent plates 46 are the chains of a pair of parallel transfer conveyors 47 and 48, which each include opposed sets of sprocket wheels 49 and 51 for supporting and driving the chains. The sprocket wheels 49 and 51 are supported on a frame 52 which is vertically translatable.

The frame 52 is joined to a set of vertical support rods 53 and 54 which are slidably secured in journals 56. Disposed beneath the scales are a pair of adjacent L-shaped levers 57 and 58, each pivoting about a pivot pin 59 and 61, respectively. The lower ends of the levers are joined by linking member 62, and a linking member 63 joins the lateral arms of the levers. Support rod 53 is pivotally joined to the end of the lateral arm of lever 57, and support rod 54 is pivotally joined to a medial portion of the lateral arm of lever 58. A downwardly directed pneumatic cylinder 64 has the piston rod 66 thereof pivotally joined to the end of the lateral arm of lever 58.

The link 62 determines that levers 57 and 58 rotate in unison, thus raising the support rods simultaneously as the piston rod retracts and lowering the support rods as the piston rod extends. In the raised position the chains of the conveyors 47 or 48 extend laterally above the plates 46 to support and transfer any stacks disposed thereon.

One set of sprocket wheels 51 is joined to a flexible rotary drive link 67, which is driven by a reversible electric motor (see FIG. 3). The conveyors 47 and 48 are thus drivable in either direction to accept or reject the stacks. Adjacent to conveyors 47 and 48 and disposed to receive accepted stacks therefrom are transfer conveyors 76 and 77. These conveyors are wire grid conveyors, driven unidirectionally to transport stacks away from the scales and toward corner stations 78 and 79, respectively. Each conveyor 76 and 77 is driven by motor 73 through belt 72, pulley 71, and miter gear trains 68 through shaft 69.

Each corner station consists of a set of parallel, drivable rollers 83 disposed in a horizontal plane to receive stacks from the conveyors 76 and 77. The rollers are driven by chains linking instant start-stop electric motors to sprocket wheels 81 and 82, respectively. These sprocket wheels are joined to the drive shaft of each corner station by spur gears. Disposed between adjacent rollers 83 are the idler wheels 84 of multiple belt transfer conveyors 86 and 87 which are driven continuously away from corner stations 78 and 79, respectively.

The idler wheels 84 are supported on a frame which is vertically translatable at that end by means of a pneumatic cylinder. When disposed in the upper position the wheels 84 and the belts 88 supported thereon extend above the rollers 83, thereby supporting and removing any stacks resting on those rollers. The distal ends of conveyors 86 and 87 include drive wheels 89, which are connected to sprocket wheels. The sprocket wheels are driven by chains linked to continuously operating electric motors.

Figure 34:
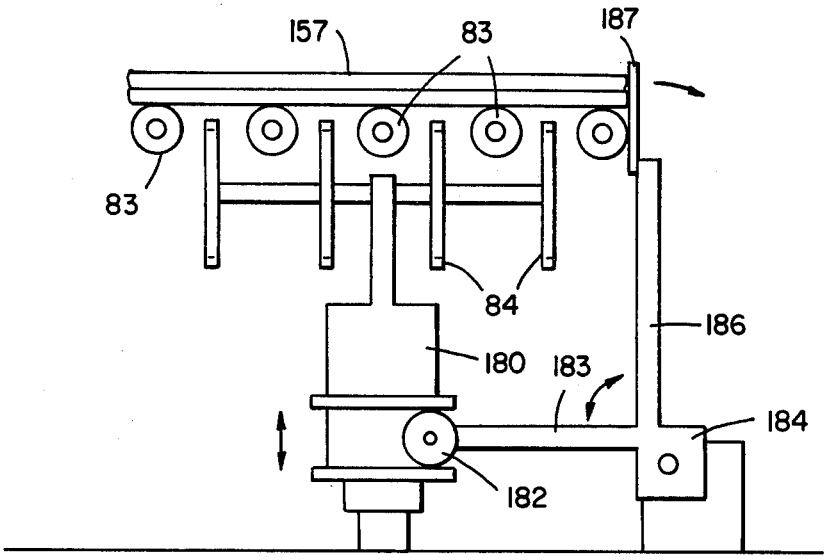
FIG. 34 is a cross sectional elevation of a corner station of the present invention.

A vertically disposed translation device 180 such as a pneumatic cylinder or a solenoid is connected to the idler wheel frame to effect vertical translation thereof, as shown in FIG. 34. The armature of the device 180 includes a pair of spaced horizontal guides 181, between which dwells a roller wheel 182. The wheel 182 is secured to lateral arm 183 which extends from web 184 pivotally disposed beneath the corner station. A vertical arm 186 extends from the web 184, and includes a stop plate 187 at the distal end thereof, adjacent to the outside roller of the corner station.

The stop 187 is disposed to determine the resting position of a stack 157 of comestible product slices as it arrives at the station, thereby placing the stack in proper orientation and disposition to be handled by subsequent apparatus. To prevent frictional drag between the stack and the stop as the stack is delivered from the station, the stop pivots out of engagement with the stack. As the device 180 is actuated to raise the idler wheels 84 and the associated belts 88, the arm 183 is pivotted by the roller wheel 182 to swing the associated arm 186 away from the corner station, thereby eliminating drag on the stack as the belts 88 convey the stack from the station.

Disposed adjacent to the delivery ends of the conveyors 86 and 87 are a pair of roller dropper units 93 and 94, respectively, similar to the roller dropper 41. Each roller dropper includes opposed banks of rollers 96 which are drivable in segments or in unison at selected periods to transport stacks received from conveyors 86 and 87 toward the ends 97 of the units. Also, each bank of rollers is secured to a housing 98 which is rotatable about its longitudinal axis, so that the banks may rotate downward and drop the stacks resting thereon to the channelizer 100 disposed therebelow.

Figure 21:
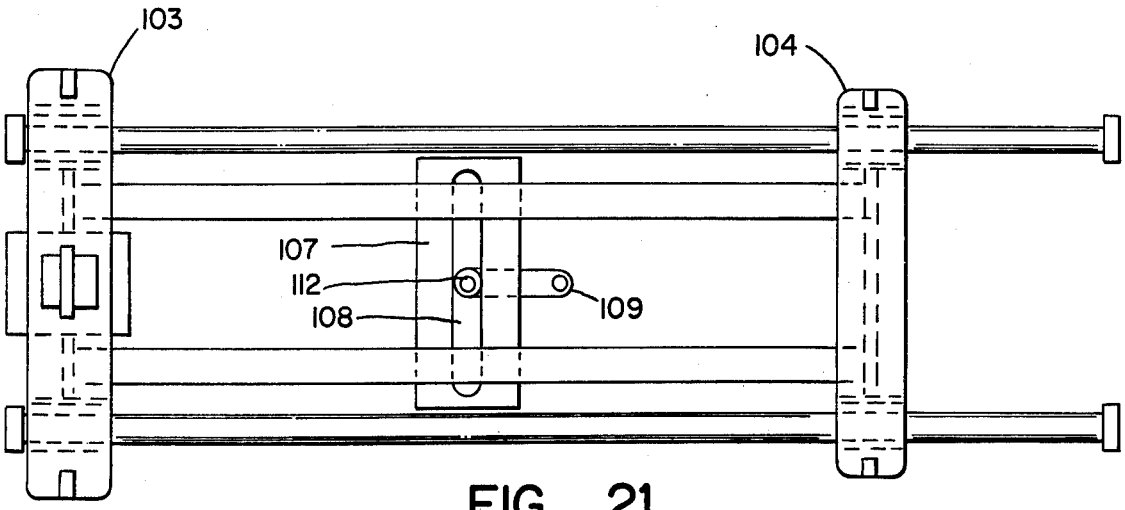
FIG. 21 is a partial plan view of the channelizer of the present invention.
Figure 22:
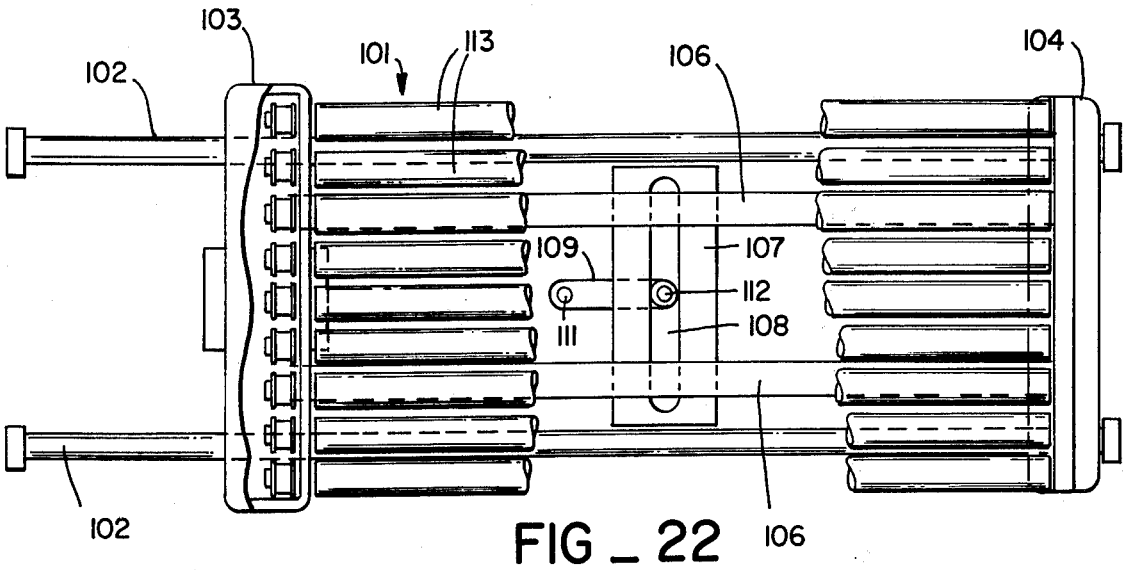
FIG. 22 is a partially broken away plan view of the channelizer of the present invention.
Figure 23:
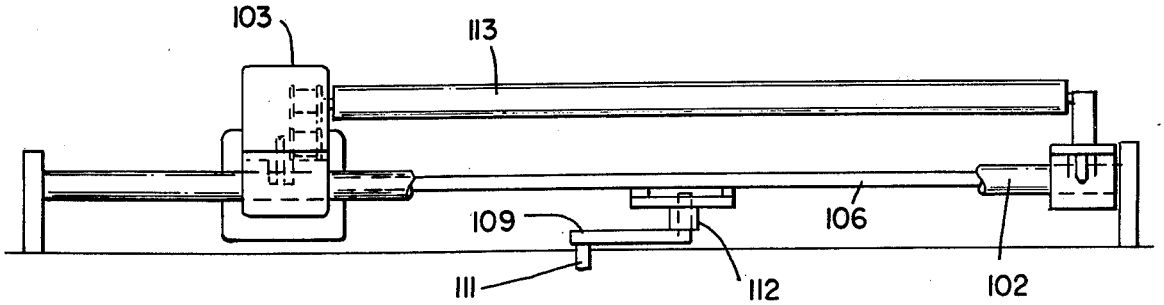
FIG. 23 is a side elevation of the channelizer of the present invention.
Figure 24:
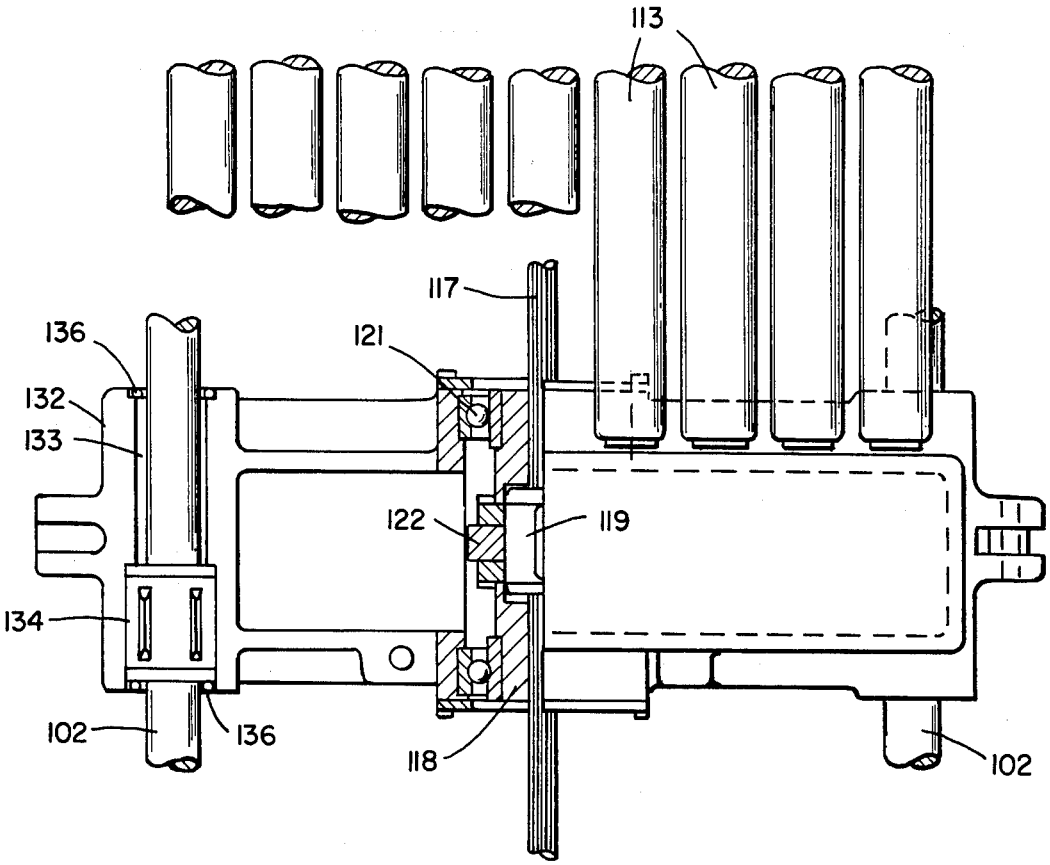
FIG. 24 is a partially sectioned top view of the roller drive mechanism of the channelizer.

As shown in FIGS. 21 through 26, the channelizer generally comprises a carriage 101 which is slidably supported on a pair of rails 102. The carriage includes opposed housing 103 and 104, joined together by longitudinally extending web members 106. A horizontal driving crank 109 is secured to a selectively rotatable shaft 111, and includes a vertical pivot pin 112 extending into the slot 108. It may be understood that rotation of the shaft 111 will cause the carriage to translate reciprocally on the rails 102, as depicted in FIGS. 21 and 22.

The carriage includes a plurality of longitudinally disposed rollers 113 extending between housings 103 and 104 and journalled therein. Within the housing 103 each roller shaft 114 supports a pulley wheel 116. A splined drive shaft 117 extends longitudinally through the housing, through a trunnion 118 and a ball bearing spline outer race 119. The trunnion is supported by ball bearings 121.

Figure 25:
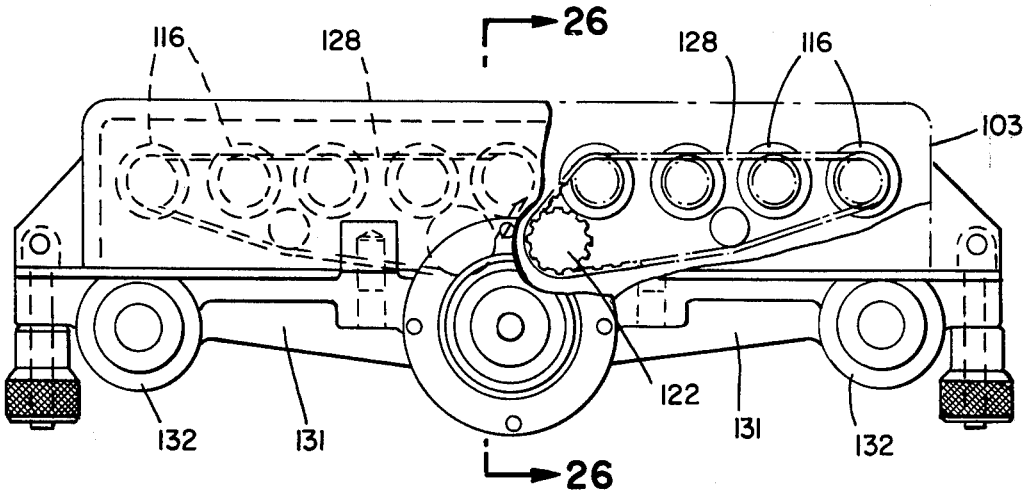
FIG. 25 is a partially sectioned end view of the roller drive mechanism of the channelizer.
Figure 26:
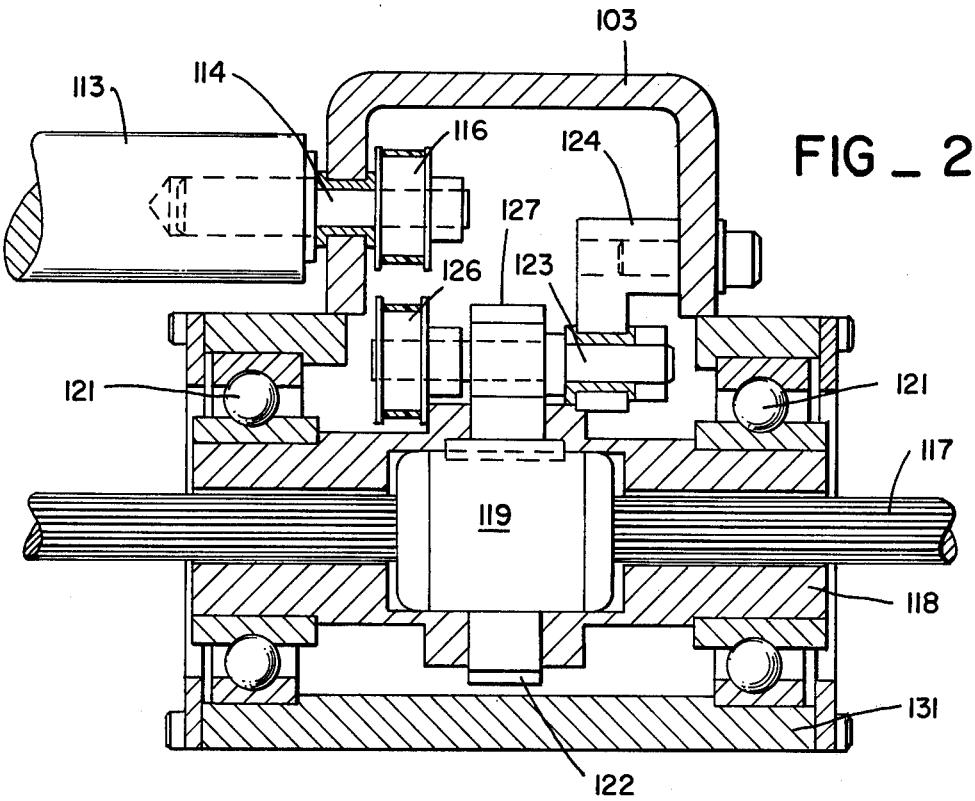
FIG. 26 is a sectional elevation of the roller drive mechanism of the channelizer, taken along line 26—26 of FIG. 25.

Secured annularly about the spline outer race 119 is a driver gear 112. Adjacent to the outer race are a pair of intermediate shafts 123, supported by gear centering blocks 124. Each shaft 123 supports a pulley wheel 126 aligned with the pulley wheels 116, and a gear 127 which meshes with the driver gear 122. A pair of timing belts 128 link the wheels 126 with respective roller pulleys 116, as shown in FIG. 25. Thus rotation of the splined shaft is transferred through the gears 122 and 127, and through the timing belts to the rollers 113.

The housing 103 is supported by a laterally extending base web member 131 which also supports the bearings 121. The web supports at its opposed ends a pair of cylindrical portions 132, each of which is provided with a bore 133 therethrough. Each bore is furnished with a ball bushing 134 which slidably receives a rail 102 therethrough, and a shaft seal 136 to seal the bore. The housing 104 is provided with similarly constructed bores with bushings, so that the carriage is supported vertically while being freely translatable along the rails 102.

As may be seen in FIG. 1, the carriage 101 extends longitudinally a greater distance than the spacing of the roller dropper units 93 and 94. The roller dropper units may simultaneously deposit two columns of two stacks on the rollers 113 of the channelizer. The carriage then is driven by the crank 109 to translate along rails 102, so that the succeeding two columns of stacks from the roller dropper units will be deposited adjacent to the initial two columns. Thus two rows of four stacks each are supported and accumulated on the channelizer.

Figure 31:
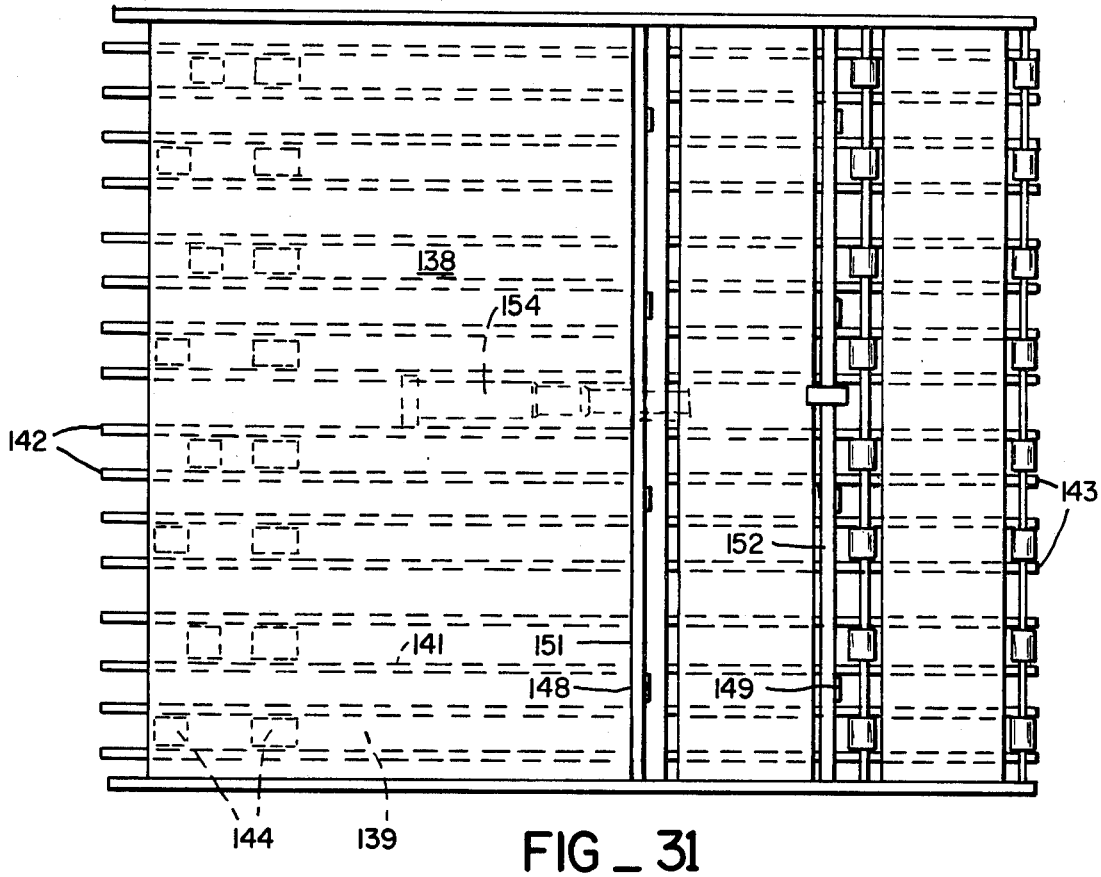
FIG. 31 is a plan view of the ramp conveyors of the present invention.
Figure 32:
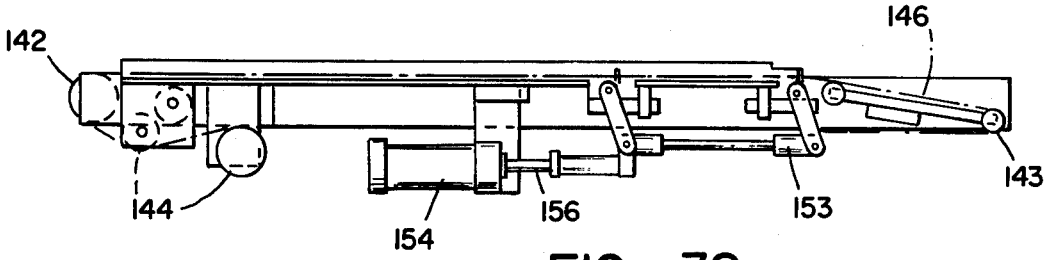
FIG. 32 is a side elevation of the ramp conveyors of the present invention.

The carriage is then driven reciprocally by the crank to translate and return to the initial (delivery) position, each column directly in line with a ramp conveyor 138. Each ramp conveyor 138 (FIGS. 31 and 31) comprises a pair of wire mesh belts 139 and 141 supported between end rollers 142 and 143. Each belt is furnished with a set of tensioning rollers 144 disposed subjacently thereto which take up any slack in the belt return. The belts are driven by rollers 142 away from the channelizer and toward a downwardly ramped delivery end 146, where a vacuum packaging machine is disposed.

To ensure that all the stacks are row aligned, each conveyor is provided with alignment tabs 148 and 149 disposed between adjacent belts 139 and 141. The tabs 148 extend from a longitudinally extending shaft 151, and the tabs 149 extend from a shaft 152 parallel thereto. These shafts are journalled to pivot freely, and are linked by an equal arm pantograph mechanism 153. A pneumatic cylinder 154 is disposed laterally below the ramp conveyor assembly, with the piston rod 156 thereof joined to the mechanism 153.

Figure 33:
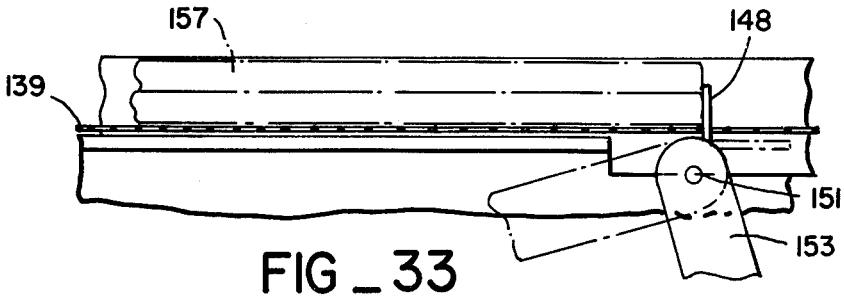
FIG. 33 is a detailed view of the alignment tabs of the conveyors of the present invention.

The alignment tabs are aligned parallel so that actuation of the pneumatic cylinder 154 will cause the tabs to rotate simultaneously into interference with the advancing stacks 157 as shown in FIG. 33, while de-actuation of the pneumatic cylinder will rotate the tabs out of the way (phantom line in FIG. 33). In practice the tabs are rotated into the interference position only momentarily, so that any stack disposed ahead of its counterparts in an advancing row will strike its respective tab and be halted momentarily. Thus a leading stack is brought into exact alignment with its row, since all stacks are briefly halted by the tabs and are released simultaneously.

Figure 35:
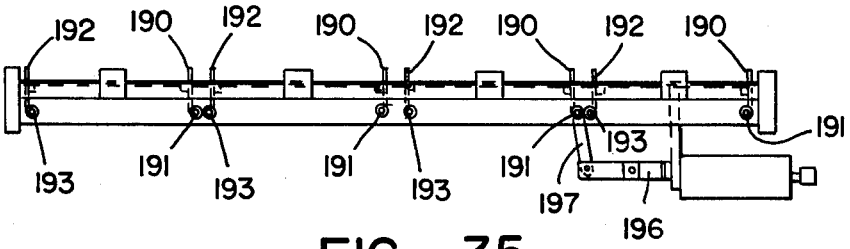
FIG. 35 is a detailed view of the lateral alignment tabs of the conveyors of the present invention.
Figure 36:
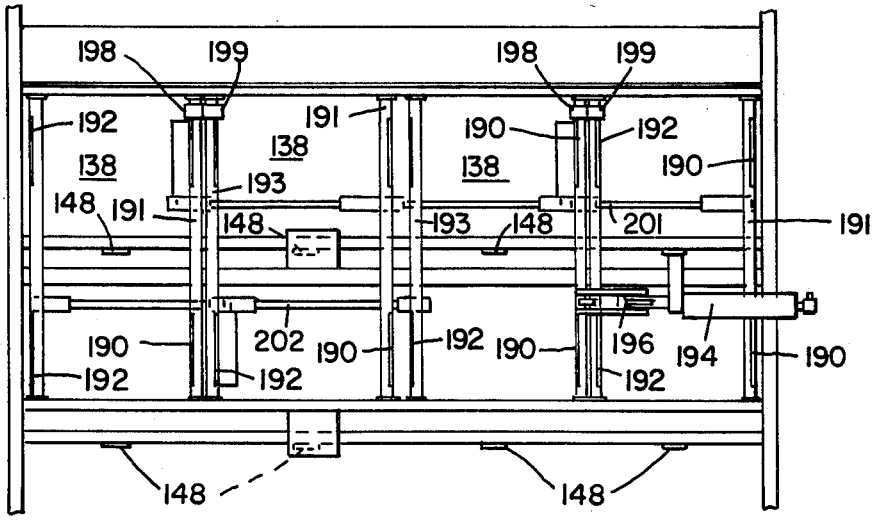
FIG. 36 is a cross sectional elevation of the lateral alignment tabs shown in FIG. 35.

As shown in FIGS. 35 and 36, lateral alignment tabs 190 and 192 are provided to align the columns of stacks on the ramp conveyor. These sets of opposed tabs are mounted on counter-rotating shafts 191 and 193 respectively, and are adapted to pivot momentarily into impingement with the passing stacks to straighten the column orientation thereof, and in the case of square slices, to orient the stacks angularly and correctly. Each set of shafts 191 and 193 is disposed between adjacent ramps 138 of the conveyor, with single shafts 191 and 193 disposed at the outer sides of the conveyor.

Beneath the ramp conveyor is disposed a pneumatic cylinder 194, with the piston rod thereof connected through pivotting linking member 196 and lever arm 197 to one shaft 191. This shaft and its adjacent counterpart 193 are provided with meshing spur gears 198 and 199 which cause the shaft 193 to counterrotate with respect to shaft 191. Linking members 201 and 202 join lever arms extending from like shafts 191 and 193 respectively, so that all rotate in unison through the same angle. The pneumatic cylinder 194 is actuated a short time after the cylinder 154 is actuated, causing the slide alignment tabs 190 and 192 to pivot upward on shafts 191 and 193, respectively, and impinge on the sides of the momentarily stopped stacks, causing them to assume the proper column alignment for the packaging machine to which they are delivered.

OPERATION OF THE PREFERRED EMBODIMENT

Figure 4:
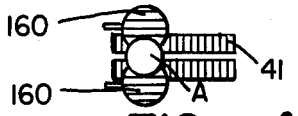
FIGS. 4–20 are consecutive schematic drawings depicting the sequential operation of the overall apparatus of the present invention.
Figure 5:
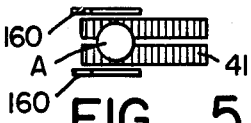
Figure 6:
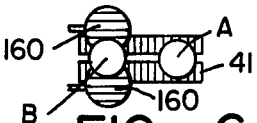
Figure 7:
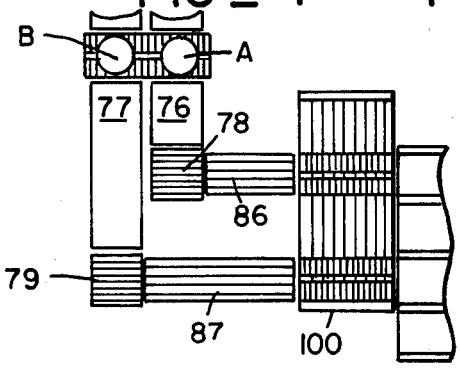

Initially, transfer conveyors 76, 77, 86, and 87 are operating continuously, and all other devices are not actuated. The slicer is set to produce 360 slices per minute, each slice being received by the stacking grid 160, as shown in FIG. 4. The stacking grids index (i.e., rotate one half turn) after every other slice, depositing a stack A of two slices on the roller dropper unit 41, as shown in FIG. 5. As the stack lands the rollers of the unit 41 are turning, transferring the stack A to the other end of the unit. The rollers are then stopped by a stack position sensor associated therewith.

Figure 8:
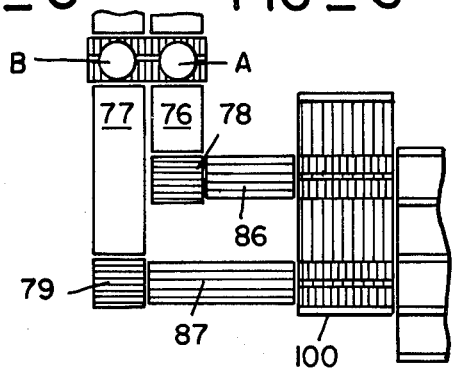

As soon as stack B is deposited on roller dropper 41 (FIG. 6), the roller dropper is actuated by a pneumatic cylinder to drop both stacks onto the grids 46 of weighing scales 42 and 43, respectively, as shown in FIG. 8. The scales require approximately 0.66 seconds to weigh each stack and dispose of it according to whether it meets the stack weight criterion. If either stack A or B do not fall within the weight parameters, both are rejected by actuating conveyors 47 and 48 in reverse, raising the frame 52 by actuating cylinder 64, and delivering both stacks to reject conveyors 162 and 164. If both stacks are acceptable the conveyors 47 and 48 deliver them to transfer conveyors 76 and 77.

Figure 9:
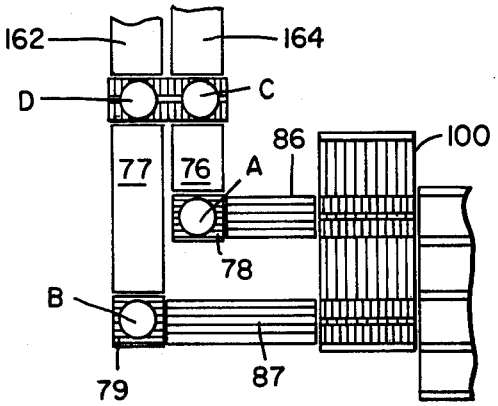
Figure 10:
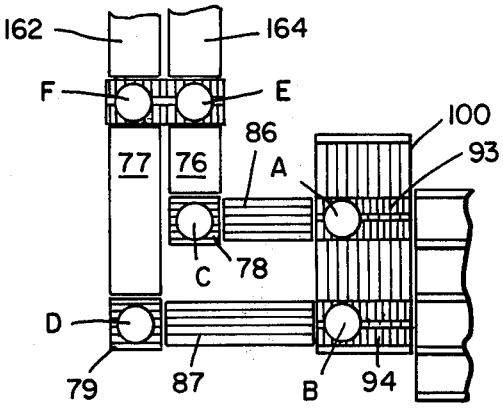

These conveyors deliver stacks A and B to corner stations 78 and 79, respectively, while stacks C and D accumulate on the roller dropper 41, as shown in FIG. 9. The rollers 83 of the corner stations are driven to accept the stacks A and B and position them on the center of each corner station, under the control of appropriate stack position sensors. If space is available downstream, transfer conveyors 86 and 87 are raised between the rollers 83 of the corner stations 78 and 79, removing the stacks A and B and delivering them to the roller dropper units 93 and 94, respectively, as shown in FIG. 10. At the same time, stacks C and D are delivered to their respective corner stations, and stacks E and F are dropped onto the weighing scales.

Figure 11:
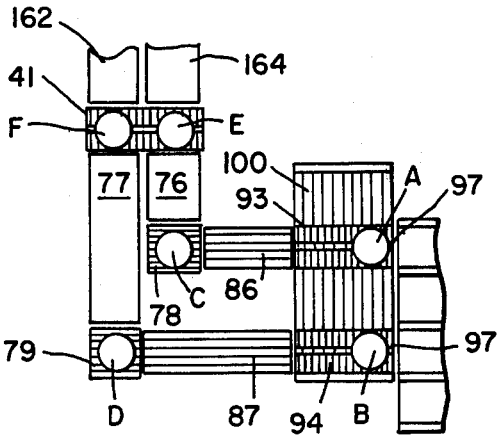
Figure 12:
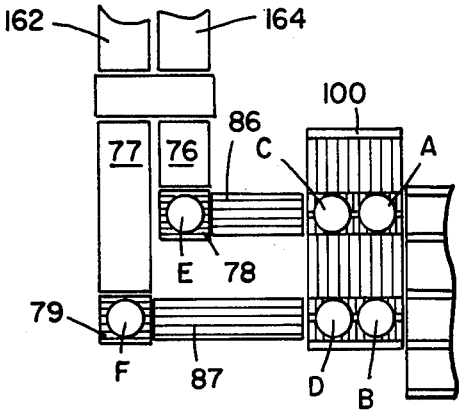
Figure 13:
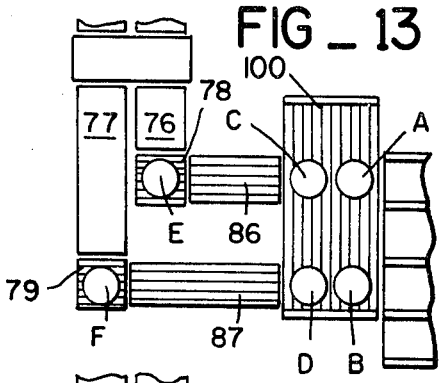
Figure 14:
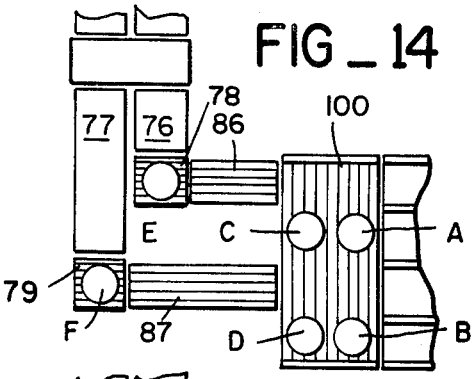
Figure 15:
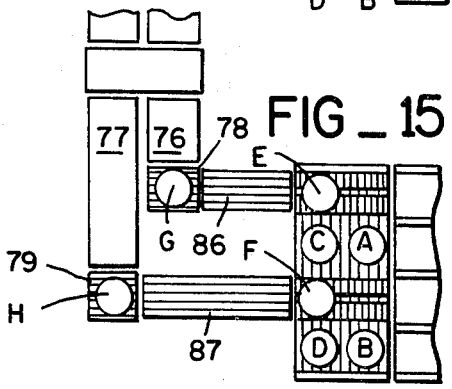
Figure 16:
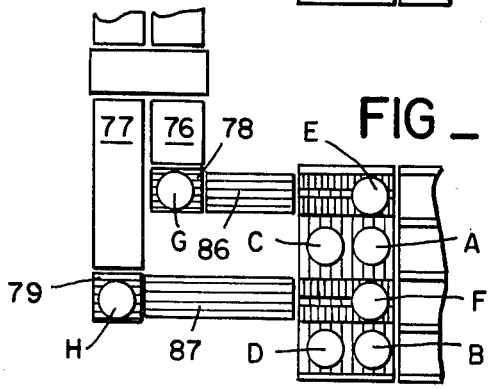
Figure 17:
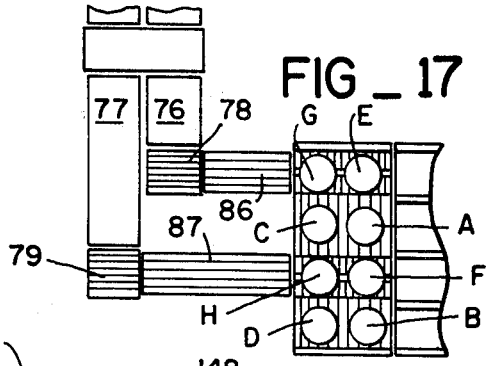

As the stacks A and B reach their respective roller dropper units, all the rollers are turning, transferring the stacks to the far ends 97 of the roller droppers, as shown in FIG. 11. When stacks A and B reach position 97, the second segment of rollers stop, while the first segment continues to run. The conveyors 86 and 87 then deliver the stacks C and D to the roller droppers 93 and 94, and the first segment of the rollers thereof are rotated to place stacks C and D adjacent stacks A and B while stacks E and F are held at the corner stations. The roller droppers 93 and 94 then index to drop the four stacks onto the rollers of the channelizer 100, as depicted in FIG. 13. At this time the channelizer is driven by the crank 109 to translate to the delivery position shown in FIG. 14, aligned with the ramp conveyors 138. Stacks E, G, and F, H, are then accumulated on roller droppers 93 and 94, through the same iterated procedures, as shown in FIGS. 15, 16, and 17. The roller droppers are then indexed again, depositing stacks E and G adjacent to stacks A and C, and depositing stacks F. and H between stacks A and C and B and D.

Figure 18:
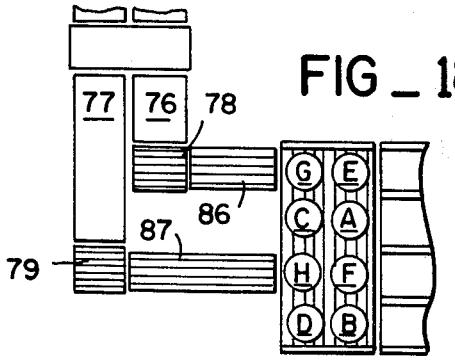
Figure 19:
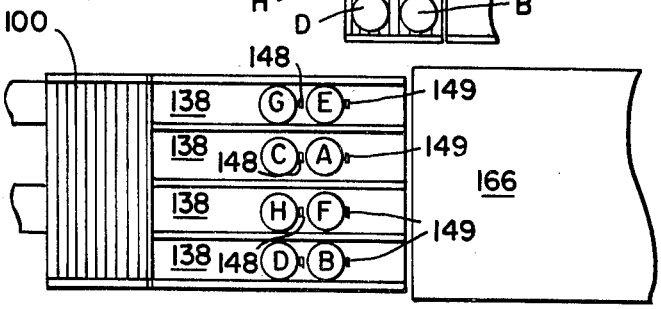
Figure 20:
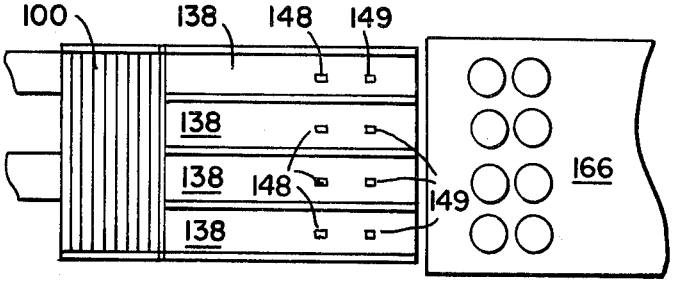

The channelizer is thus supporting eight stacks of slices, arrayed in two rows of four stacks each, as shown in FIG. 18. The rollers 100 are then driven by the spline shaft 117 to deliver the stacks to the ramp conveyors 138. It should be noted that each ramp conveyor is aligned with a column of the stack matrix, so that each conveyor receives two stacks. As the stacks proceed down the ramp conveyor a sensor triggers a timing device to operate the pneumatic cylinder 154 and, shortly thereafter, 194, to actuate momentarily the alignment tabs 148, 190, 149, and 192. These tabs retard any leading stacks in a row (FIG. 19) and align the columns exactly.

This well-defined matrix of stacks is then delivered to a vacuum packaging machine 166 (FIG. 20) where each stack is individually wrapped in a packet, and the packets are assembled into a finished package. Meanwhile the channelizer carriage indexes reciprocally to the position of FIGS. 7 – 13 to receive the next four stacks coming from the slicer. The wrapping machine 166 receives a group of eight stacks approximately one every 2.66 seconds. Thus the high speed, 360 slice/minute output of the slicer is transformed into parallel rows of stacks which are delivered sequentially and wrapped simultaneously in rows of two.

Figure 27:
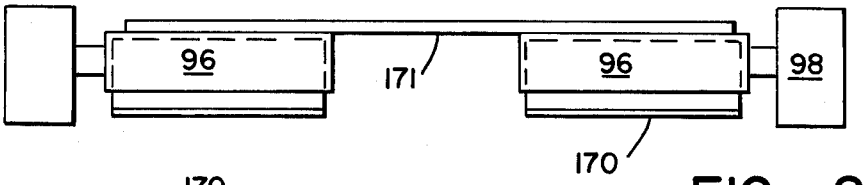
FIG. 27 is an end elevation of a roller dropper assembly of the present invention in the unactuated position.
Figure 28:
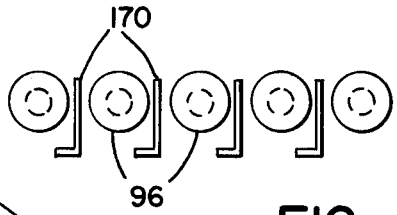
FIG. 28 is a partial side view of a roller dropper assembly in the disposition of FIG. 27.
Figure 29:
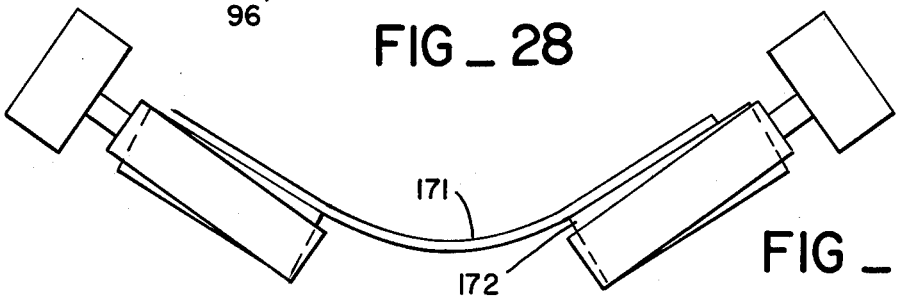
FIG. 29 is an end elevation of a roller dropper assembly in an actuated disposition.
Figure 30:
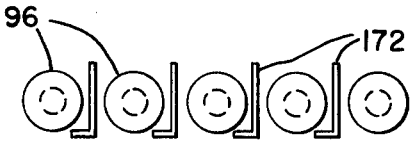
FIG. 30 is a side view of the rollers of the roller dropper assembly as depicted in FIG. 29.

The roller dropper units 41, 93, and 94 may comprise an improved version of the device disclosed in the aforementioned U.S. Pat. No. 3,848,725. As shown in FIGS. 27–30, adjacent rollers 96 are separated by vertically disposed support vanes 170, all of the vanes extending from the housing 98 and secured therein in pivotable fashion so that they may pivot through a small angle in a vertical plane. With the rollers in the horizontal disposition the top edges 172 of the vanes are aligned just below the upper extent of the roller peripheries, as shown in FIGS. 27 and 28. Thus, the horizontal rollers alone support a stack 171 of slices of comestible product.

As the roller dropper housings 98 are actuated to counter-rotate and the rollers incline downwardly (FIG. 29), the vanes rotate simultaneously upwardly respect to each housing and the rollers fixedly associated therewith. This movement causes the vane edges 172 to extend above the upper extent of the rollers 96 (FIGS. 29 and 30), so that the support of the stack shifts from the rollers to the vanes. As the rollers 91 are indexed downward, their drive motors are stopped. However, internal gearing causes the rollers to turn slightly as they are indexed. This will cause angular misalignment of the stacks as they sit on the rollers. The vanes take up the support of the stacks before this misalignment can occur, so that the stacks are deposited in proper orientation.

It should be noted that an extensive electronic sensing and control system is required to coordinate and actuate the apparatus of the present invention. Such electronic system may be apparent to one skilled in the art, and is notwithin the purview of the present invention.

I claim:

1. In a conveyor system for delivering groups of articles in a sequential manner, the conveyor system including a plurality of paired, laterally spaced belts driven uniformly and longitudinally, and each article being supported on a pair of adjacent belts; apparatus for arranging said groups of articles in exact row and column matrix alignment, said apparatus including a plurality of row alignment tabs, one for each of said articles in a row, each of said row alignment tabs disposed between the two belts of one of said pairs of belts, said row alignment tabs extending from a laterally disposed common pivot shaft, said pivot shaft being secured subjacently of the upper course of said belts, means for rotating said pivot shaft selectively to pivot said tabs into interference with each article of each row as it advances on said belts, whereby any leading articles will be momentarily halted and brough into alignment with lagging articles in the same row; a first plurality of column alignment tabs each disposed on one side of respective columns of articles, a second plurality of column alignment tabs each disposed on the other side of said respective columns of articles, each of said first plurality of column alignment tabs being paired with one of said second plurality of column alignment tabs in opposed relationship with one of said columns disposed therebetween, said first and second plurality of column tabs being diposed between said pairs of said plurality of belts and at the lateral extremities thereof, and shaft means for simultaneously rotating said first and second plurality of column alignment tabs into impingement with said sides of said articles.

2. The device of claim 1, wherein each of said column alignment tabs is disposed adjacent to and upstream of one of said row alignment tabs, and further including time delay means for actuating said shaft means a short time after actuation of said means to rotate said pivot shaft, whereby said column alignment tabs impinge upon said sides of said articles after said row alignment tabs have momentarily halted said articles.

* * * * *